US008544217B2

(12) United States Patent
Andreini et al.

(10) Patent No.: US 8,544,217 B2
(45) Date of Patent: Oct. 1, 2013

(54) GLASS BUILDING PANEL AND BUILDING MADE THEREFROM

(75) Inventors: David Andreini, San Francisco, CA (US); Karl Backus, Emeryville, CA (US); Jon F. Cooksey, Menlo Park, CA (US); Tim Eliassen, Sunapee, NH (US); Scott David Hazard, Campbell, CA (US); Holger Krueger, Schwabmuenchen (DE); Peter Lenk, London (GB); James O'Callaghan, Winchester (GB); Yutang Zhang, Beijing (CN)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 13/107,116

(22) Filed: May 13, 2011

(65) Prior Publication Data

US 2012/0090251 A1 Apr. 19, 2012

Related U.S. Application Data

(60) Provisional application No. 61/362,277, filed on Jul. 7, 2010.

(51) Int. Cl.
*E04B 1/32* (2006.01)
*E04B 1/342* (2006.01)
*E04B 7/08* (2006.01)

(52) U.S. Cl.
USPC ..... 52/80.1; 52/223.3; 52/246; 52/236.2; 52/DIG. 17

(58) Field of Classification Search
USPC ..... 52/247, 245, 236.2, 223.3, 80.1, 52/86.1, 483.1, DIG. 17
See application file for complete search history.

(56) References Cited

U.S. PATENT DOCUMENTS

| | | | | |
|---|---|---|---|---|
| 1,571,484 | A * | 2/1926 | Knight | 52/247 |
| 2,576,167 | A * | 11/1951 | Zick | 220/652 |
| 3,295,265 | A * | 1/1967 | Hida | 52/82 |
| 4,112,644 | A * | 9/1978 | Allen | 52/245 |
| 5,560,151 | A | 10/1996 | Roberts | |
| 5,724,775 | A * | 3/1998 | Zobel, Jr. et al. | 52/82 |
| 5,853,828 | A * | 12/1998 | Schimmelpenningh et al. | 428/34 |
| 6,132,882 | A * | 10/2000 | Landin et al. | 428/437 |
| 6,177,161 | B1 | 1/2001 | Riom et al. | |

(Continued)

FOREIGN PATENT DOCUMENTS

EP 0 953 694 A1 11/1999

OTHER PUBLICATIONS

Article about NY apple store, published 2006 found at: http://www.galinsky.com/buildings/applefifthavenue/index.html.*
Exterior image of Apple NY store.*

(Continued)

*Primary Examiner* — Brian Glessner
*Assistant Examiner* — Brian D Mattei
(74) *Attorney, Agent, or Firm* — Sterne, Kessler, Goldstein & Fox P.L.L.C.

(57) ABSTRACT

A building panel and a building formed therefrom, where the building includes a plurality of building panels arranged to form a cylindrical shape, where each panel comprises a single, or monolithic, glass piece, where each glass piece is substantially rectangular and includes two opposing long sides extending in a height direction and two opposing short sides extending substantially in a width direction, and where each glass piece forms an identical circular arc when viewed from either of the two opposing short sides.

25 Claims, 15 Drawing Sheets

(56) References Cited

U.S. PATENT DOCUMENTS

| | | | | |
|---|---|---|---|---|
| 6,546,690 | B1 | 4/2003 | Lamberts | |
| 2002/0029535 | A1 * | 3/2002 | Loper | 52/302.1 |
| 2005/0042422 | A1 * | 2/2005 | Bennison et al. | 428/137 |
| 2008/0155931 | A1 | 7/2008 | Shoji | |

OTHER PUBLICATIONS

Interior images of Apple NY store found at: http://www.slim69.com/wonderful-glass-cube-design-entrance-in-the-apple-store-fifth-avenue-ny/amazing-glass-spiral-staircase-with-exotic-elevator-cylinder-in-the-center/.*

Images of Bradley Residence found at: http://design-milk.com/bradley-residence-scottsdale-by-michael-p-johnson/ and dated Mar. 12, 2009.*

Kanagawa Institute of Technology Workshop article dated Feb. 6, 2009 found on the wayback machine at: http://web.archive.org/web/20090206103740/http://archrecord.construction.com/projects/portfolio/archives/0811kanagawa-1.asp.*

Images of Kanagawa Institute of Technology Workshop found at: http://inhabitat.com/amazing-light-filled-glass-studio-in-japan/glassstudio-ed01/.*

Images of the roof of Galeria Colbert renovated in 1985 found at: http://www.parissecret.fr/galerie-colbert-de-verre-et-de-marbre/olympus-digital-camera-103/.*

* cited by examiner

GLASS BUILDING PANEL AND BUILDING MADE THEREFROM

CROSS-REFERENCE TO RELATED APPLICATION

This application claims priority to U.S. Provisional Application No. 61/362,277, filed Jul. 7, 2010, which is incorporated herein in its entirety by reference thereto.

BACKGROUND OF THE INVENTION

1. Field of the Invention

The present invention relates to building panels and to a building made therefrom.

More particularly, exemplary embodiments of the present invention relate to glass building panels and to a building made therefrom, where the panels are curved and the building is cylindrical in shape.

2. Background of the Invention

Glass structures have been around for some time. Such structures must meet structural requirements for their particular operation, and must support loads and forces of expected magnitudes. Because of the structural requirements for supporting such loads and forces, glass pieces used in such glass structures may be formed of a laminate structure that includes layers of glass and bonding materials. A laminate structure is much stronger than any one layer by itself and thus it can support loads and forces of greater magnitude. For long spans of single, or monolithic, glass panels, however, the conventional laminate structure may deflect for lack of sufficient support, and may be unsuited to withstand some loads or forces of great magnitude. Such difficulties have conventionally prevented the creation of large buildings made of large glass panels and supports, because the structural properties needed to construct the buildings limited the size of the glass panels that could be used. This is particularly problematic in the case of structures with curved walls, such as a cylindrical shaped building.

SUMMARY OF THE INVENTION

The invention relates, in one embodiment, to a building panel. The building panel may be glass and may include a plurality of glass layers. The building panel may also be curved.

The invention relates, in another embodiment, to a building made using building panels where the building panels may be glass, may include a plurality of glass layers, and may be curved. The building may include glass fins and glass beams for support, and a glass roof The glass building panels, glass fins, glass beams, and glass roof may be connected together by a plurality of fittings.

Additional features of the invention will be set forth in the description that follows, and in part will be apparent from the description, or may be learned by practice of the invention.

An embodiment of the present invention discloses a building panel, including a single, or monolithic glass piece, wherein the glass piece is substantially rectangular and includes two opposing long sides extending in a height direction and two opposing short sides extending substantially in a width direction, and wherein the glass piece forms a circular arc when viewed from either of the two opposing short sides.

An embodiment of the present invention also discloses a building, including a plurality of panels, wherein each panel includes a single, or monolithic, glass piece, wherein each glass piece is substantially rectangular and includes two opposing long sides extending in a height direction and two opposing short sides extending substantially in a width direction, and wherein each glass piece forms an identical circular arc when viewed from either of the two opposing short sides.

BRIEF DESCRIPTION OF THE DRAWINGS

The invention may best be understood by reference to the following description taken in conjunction with the accompanying drawings in which.

DETAILED DESCRIPTION OF THE INVENTION

The following detailed description of exemplary embodiments of the present invention refers to the accompanying figures that illustrate the exemplary embodiments. Other embodiments are possible and may fall within the scope of the present invention. Modifications can be made to the exemplary embodiments described herein without departing from the spirit and scope of the present invention. Therefore, the following detailed description is not meant to be limiting. Further, it would be apparent to one of skill in the art that the exemplary embodiments described below can be implemented in many different embodiments. Any actual embodiment described is not intended to be limiting. The operation and behavior of the exemplary embodiments presented are described with the understanding that various modifications and variations of the exemplary embodiments may be within the scope of the present invention.

Figure 1:
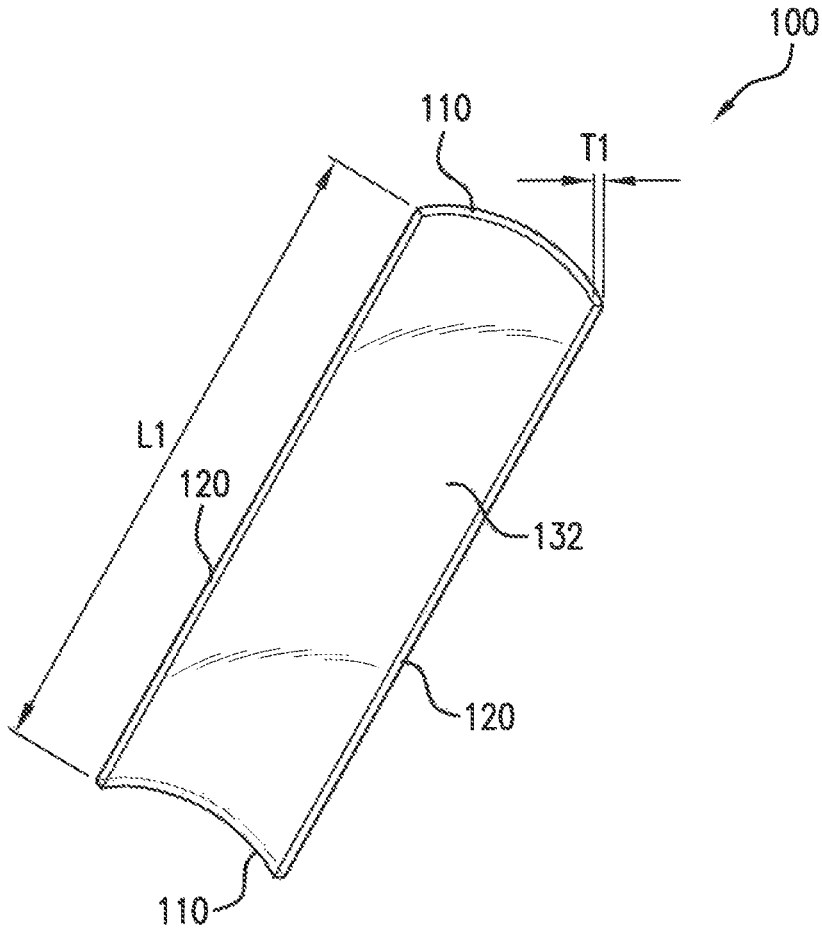
FIG. 1 is a perspective view of a building panel according to an exemplary embodiment of the present invention.
Figure 2:
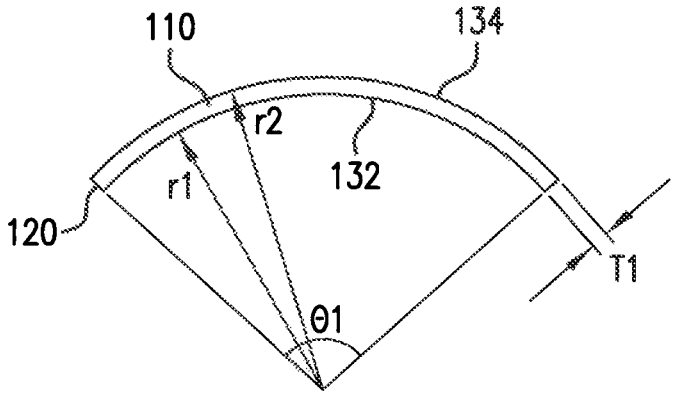
FIG. 2 is a top view of the panel of FIG. 1.
Figure 3:
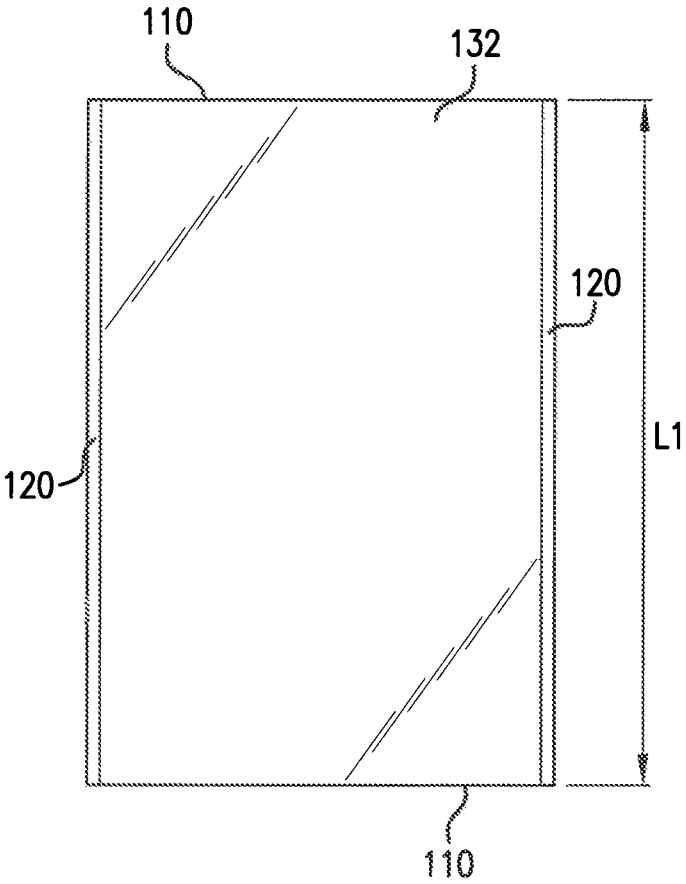
FIG. 3 is a front view of the panel of FIG. 1.

FIG. 1 is a perspective view of a building panel 100 according to an exemplary embodiment of the present invention, FIG. 2 is a top view of panel 100, and FIG. 3 is a front view of panel 100. Panel 100 may include two short sides 110, two long sides 120, an inner surface 132, and an outer surface 134.

Panel 100 may be formed of a single, or monolithic, glass piece, including a glass piece having a layered or laminate structure. The glass used to form panel 100 may be a tempered, low iron glass. Panel 100 may be formed of multiple layers of glass so as to form a laminated structure. Such an exemplary embodiment is described in greater detail below with reference to FIG. 4. Depending on the properties of the materials used to form panel 100, it may be substantially transparent, but may alternatively be formed to be translucent or opaque, or variants thereof.

U.S. Pat. No. 7,765,362 to Jobs et al., issued Jan. 23, 2007, describes laminated glass structures, and is incorporated by reference herein in its entirety.

Short sides 110 may be curved to form a circular arc shape and may be positioned parallel to each other and perpendicular to long sides 120, so as to extend substantially in a width direction with respect to panel 100. "Circular arc", as used herein, may refer to a segment of the circumference of a circle. Long sides 120 may be straight and may be positioned parallel to each other and perpendicular to short sides 110 so as to extend in a height direction with respect to panel 100. Short sides 110 and long sides 120 may be positioned such that panel 100 appears substantially rectangular in shape when viewed from the front (as, for example, in FIG. 3). Long sides 120 may have a length L1 where L1 is, for example, greater than 26' (e.g., 39'1 7/16", 40', 40'10 3/16", 41'2 19/32", or 45').

Short sides 120, due to their circular arc shape, may have an inner edge arc, corresponding to inner surface 132, and an outer edge arc, corresponding to outer surface 134. The inner edge arc and the outer edge arc share the same center point, and subtend the same angle θ1. The inner edge arc has an inner radius r1 with respect to the shared center point, and the outer edge arc has an outer radius r2 with respect to the shared center point. Short sides 120 have an arc length corresponding to each of inner radius r1 and outer radius r2. A thickness T1 of panel 100 may be the difference between outer radius r2 and inner radius r1.

In an exemplary embodiment, angle θ1 may, for example, be 30°, inner radius r1 or outer radius r2 may be between 15' and 17' (e.g., inner radius r1 may, be 16'1 13/16" and outer radius r2 may be 16'3"), and thickness T may be, for example, between 0.5" and 4" (e.g., 1 3/16"). In some exemplary embodiments, short sides 120 may have an arc length of, for example, between 8' and 9' (e.g., 8'5½"), which may correspond to inner radius r1, outer radius r2, or any length in between.

Inner surface 132 and outside surface 134 may maintain a constant profile throughout a length of panel 100, the constant profile corresponding to the circular arc shape of short sides 110.

Figure 4:
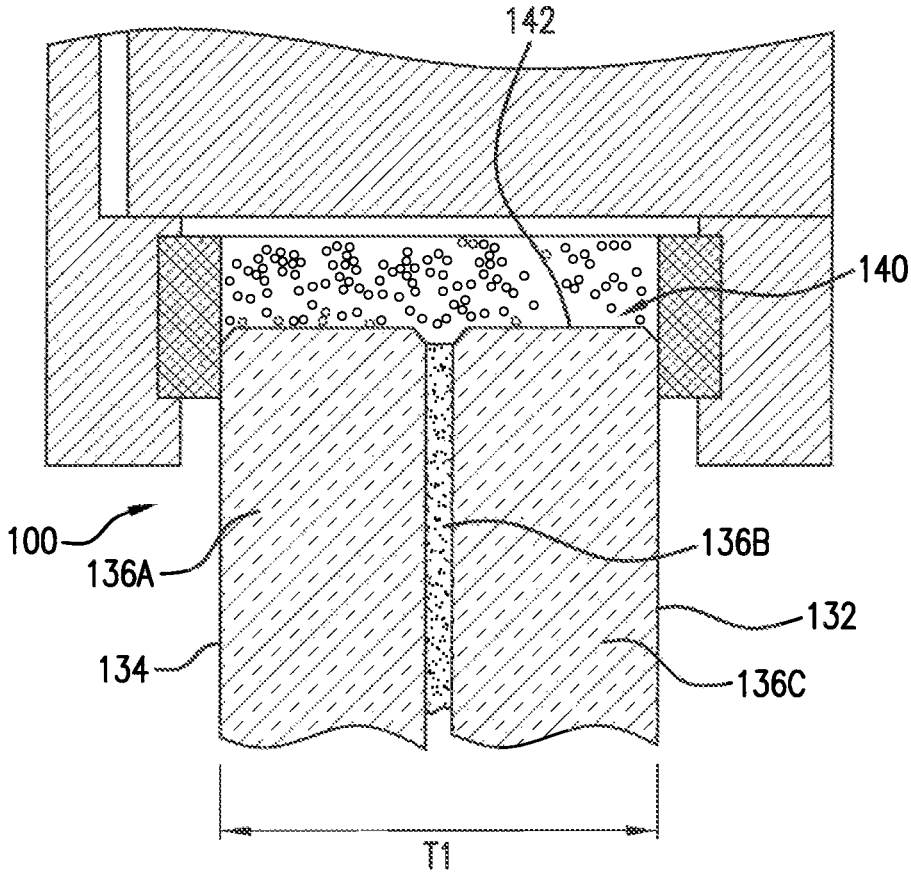
FIG. 4 is an enlarged schematic view of an edge profile of the panel of FIG. 1.

FIG. 4 is an enlarged schematic view of an edge profile of the panel of FIG. 1. As discussed above, panel 100 may be composed of multiple layers. Such layers may include an outer surface layer 136A corresponding to outer surface 134 and an inner surface layer 136C corresponding to inner surface 132. Panel 100 may further include intervening layer 136B. Layers 136A and 136C may be made of glass and layer 136 B may be made of an adhesive. Layers 136A through 136C may be formed together through, for example, a laminating process while in a substantially flat state, and may acquire their arc shape through a slumping process by heating panel 100 over a mold.

In some exemplary embodiments, a layer of adhesive (corresponding to layer 136B in FIG. 4) is disposed between adjacent glass layers. The adhesive is preferably transparent. Any suitable adhesive may be used as would be apparent to one of skill in the art. For example, the adhesive may be polyvinyl butyral (PVB) or an adhesive such as that known as SentryGlas® Plus (SGP) interlayer, manufactured by Dupont of Wilmington, Del. Each of layers 136A through 136C may have a thickness independent of the others of layers 136A through 136C. In some exemplary embodiments, layers 136A and 136C have an identical thickness, and layer 136B has a thickness less than that of layers 136A and 136C. For example, the thickness of layers 136A and 136C may be 9/16", and the thickness of layer 136B may be 1/16".

Panel 100 may have an edge profile 140 extending along short sides 110 and long sides 120. In the exemplary embodiment of FIG. 4, edge profile 140 includes chamfers on each side of panel 100. As would be appreciated by one of skill in the art, edge profile 140 can be configured in a variety of ways in order to accomplish a variety of ends, tor example, increasing handling safety or facilitating mounting.

Panel 100 may further include anchor points (not shown). As would be appreciated by one of skill in the art, positions near the periphery of panel 100 may be integrally formed with fittings 210, including mounting or joining hardware, or a configuration for receiving such fittings 210, so as to facilitate use of panel 100 in a variety of operations, such as, for example, as an exterior panel in a building. For example the fittings 210 may be laminated with the glass so as to be integrally formed therewith.

Figure 5:
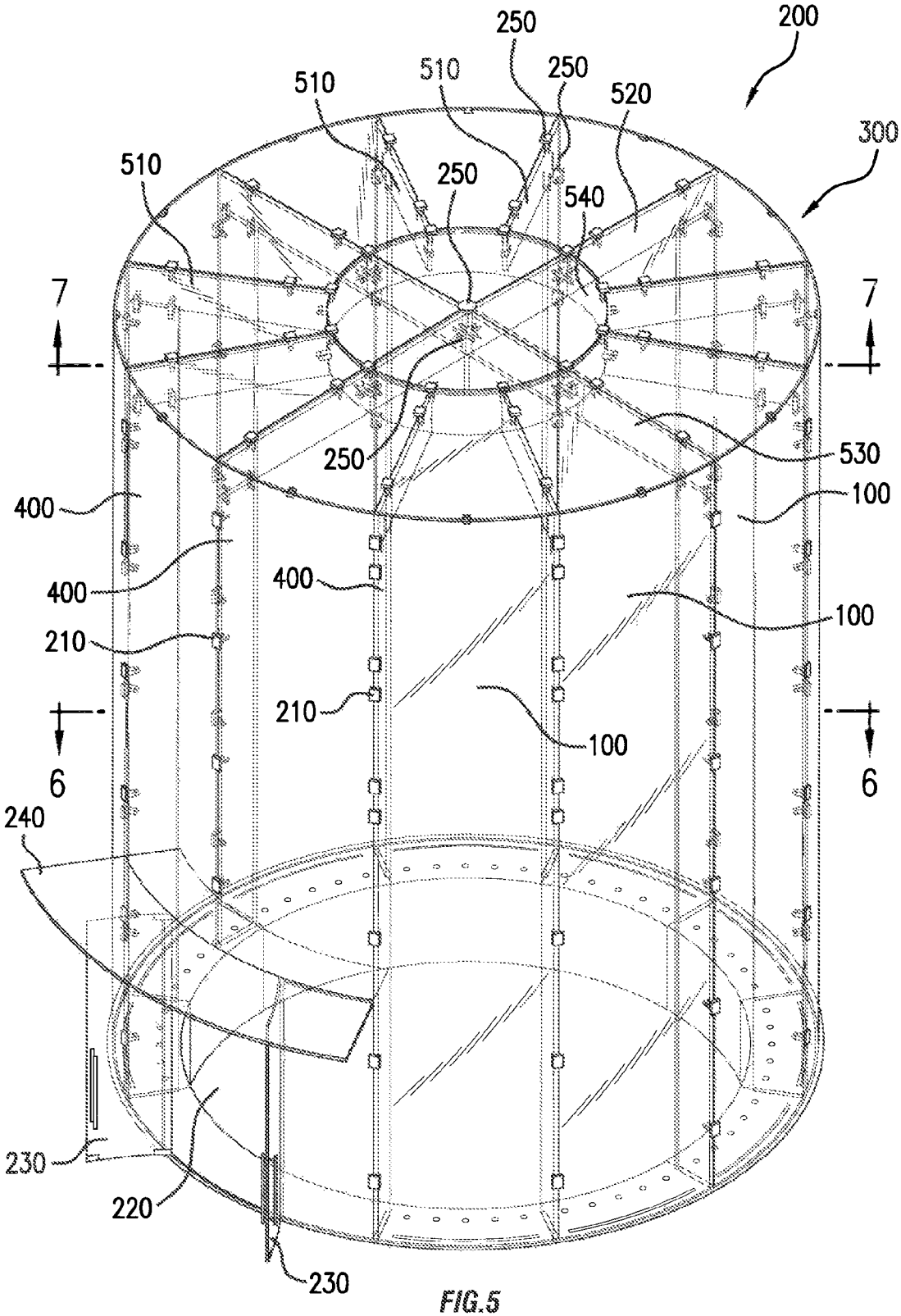
FIG. 5 is a perspective view of a building incorporating the panel of FIG. 1, according to an exemplary embodiment of the present invention.
Figure 18:
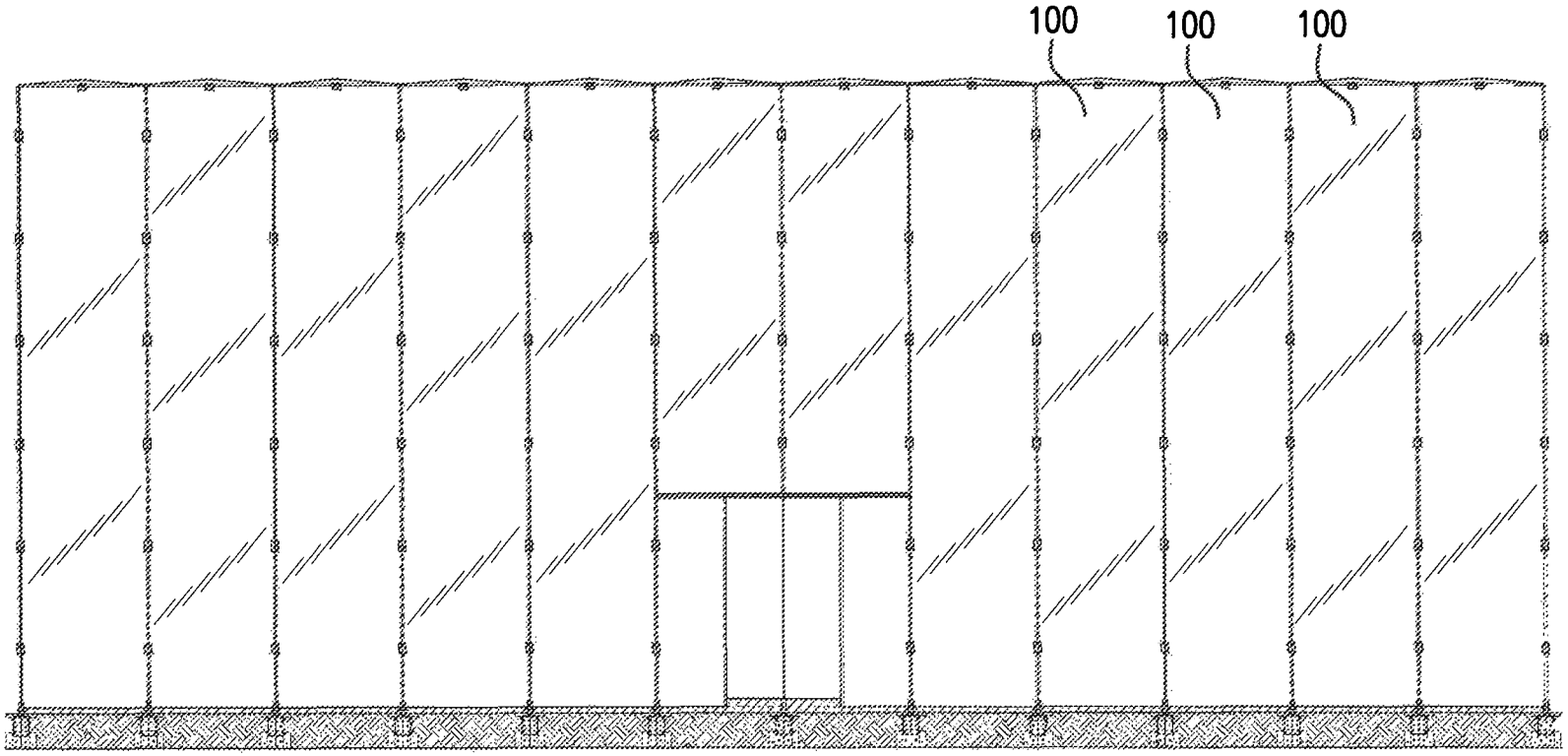
FIG. 18 is an expanded reference view of the building of FIG. 5.

FIG. 5 is a perspective view of a building 200 incorporating a plurality of panels 100, according to an exemplary embodiment of the present invention. Building 200 includes panels 100, a roof 300, fins 400, first beams 510, second beams 520, a third beam 530, and a cylindrical support 540. FIG. 18 is an expanded reference view of building 200 in which building 200 is depicted in an "unrolled" state (i.e., panels 100 are positioned in a row, rather than as a cylinder).

Building 200 includes 12 panels 100 arranged such that long sides 120 of adjacent panels meet, and together panels 100 form a vertical cylinder. The circular arcs of all panels 100 share a center point, corresponding to a longitudinal axis extending through the center of the vertical cylinder. The circular arcs of each panel 100 may subtend an angle θ1 (shown in FIG. 2). In the case where θ1 is, for example, 30°, building 200 will include 12 panels 100, in order to complete the cylinder.

Figure 6:
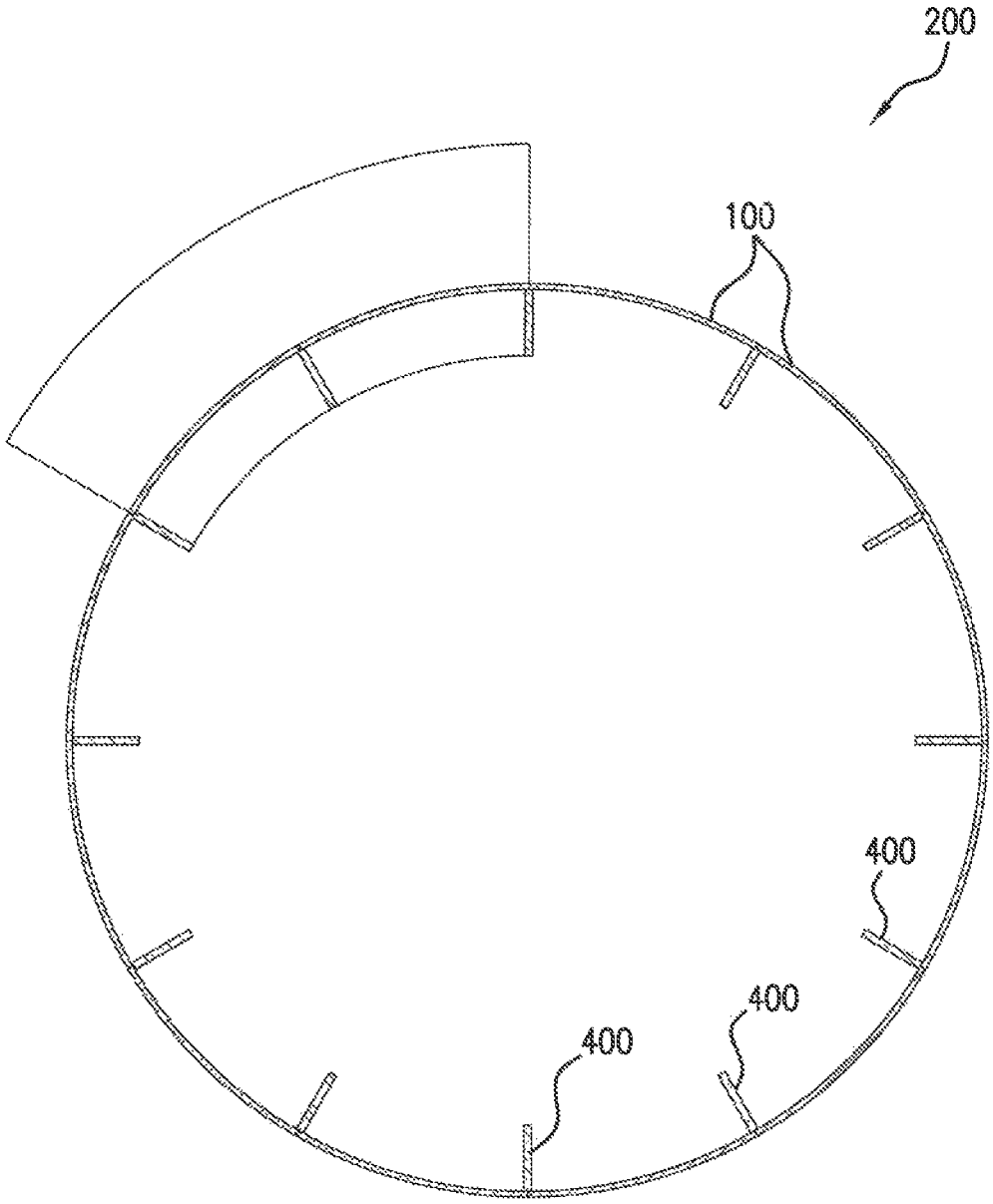
FIG. 6 is a cross-sectional view of the building of FIG. 5, taken along line 6-6.
Figure 8:
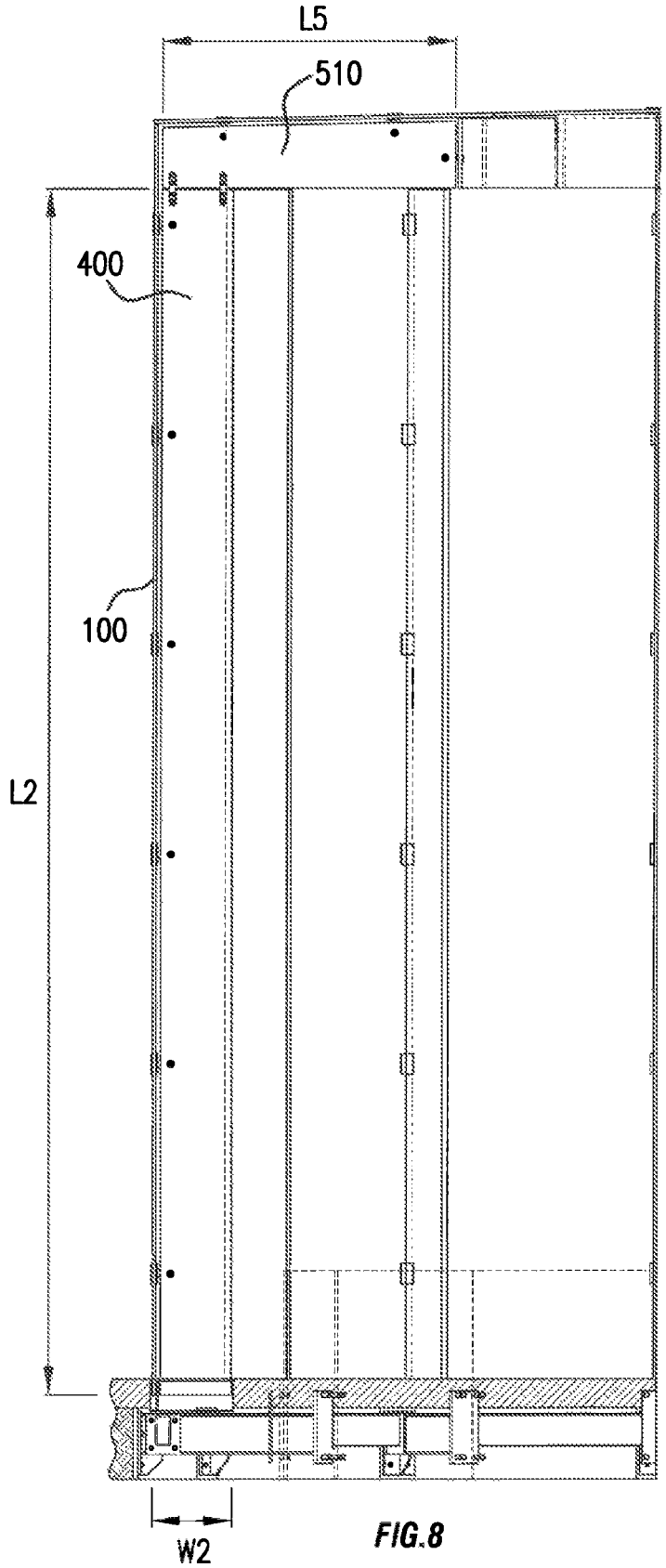
FIG. 8 is a side view of the fin and beam construction of the building of FIG. 5.
Figure 9:
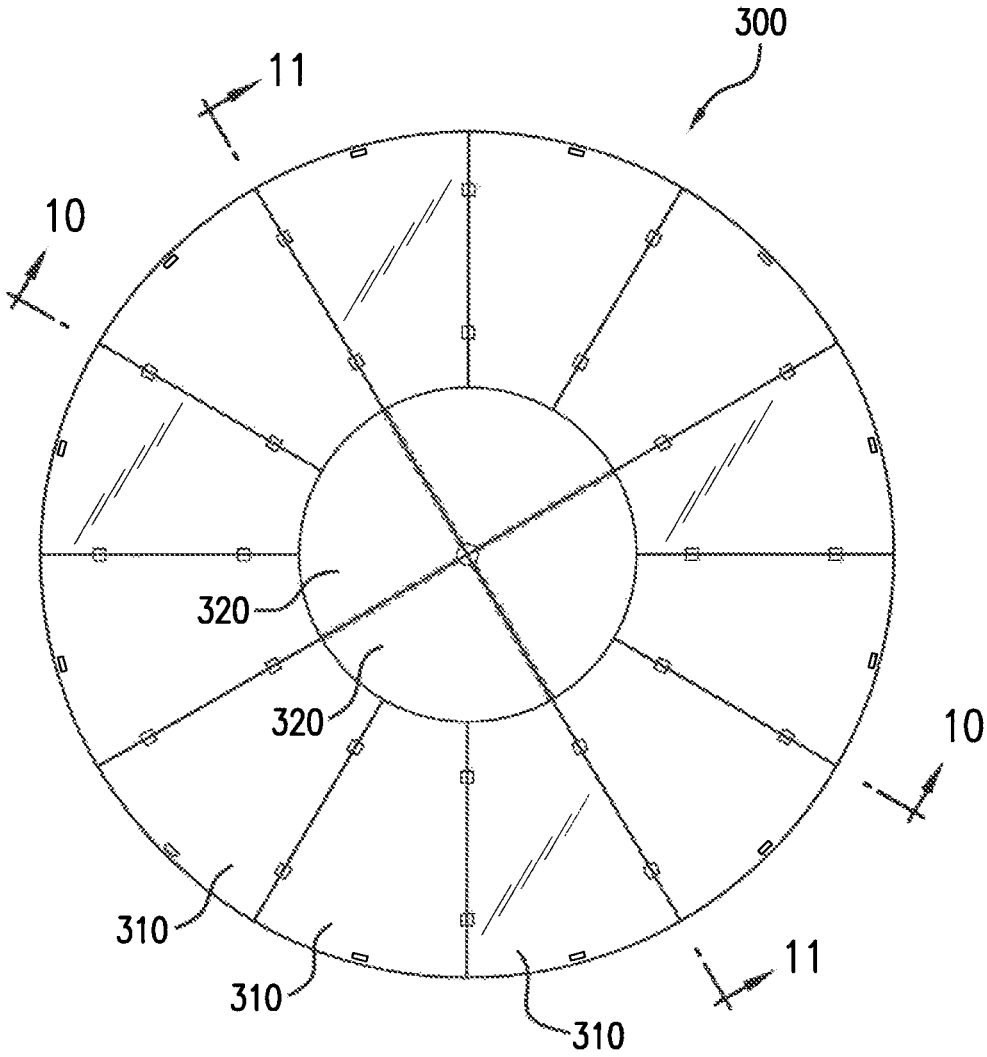
FIG. 9 is a top view of the building of FIG. 5.
Figure 10:
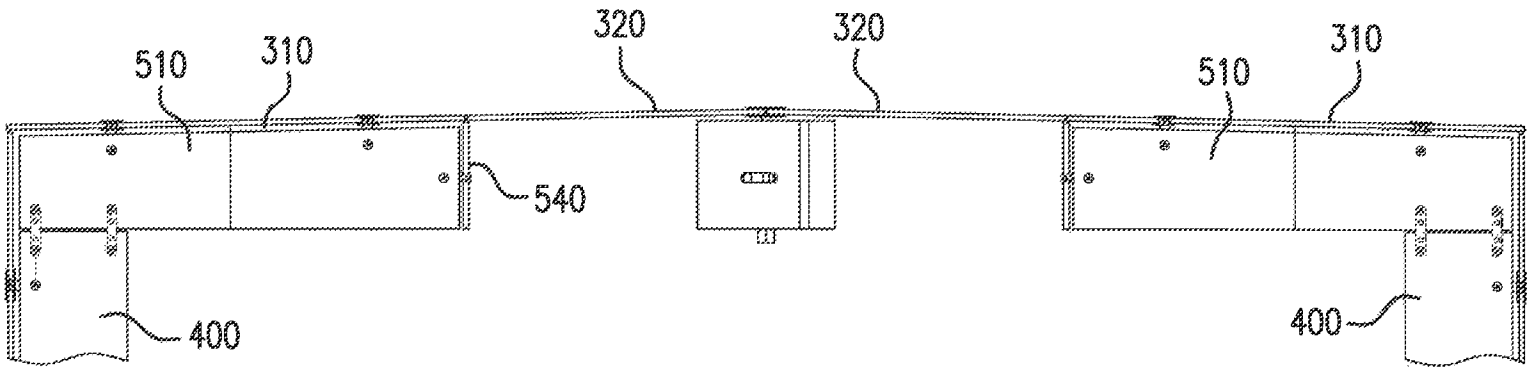
FIG. 10 is a cross-sectional view of the building of FIG. 9, taken along line 10-10.
Figure 11:
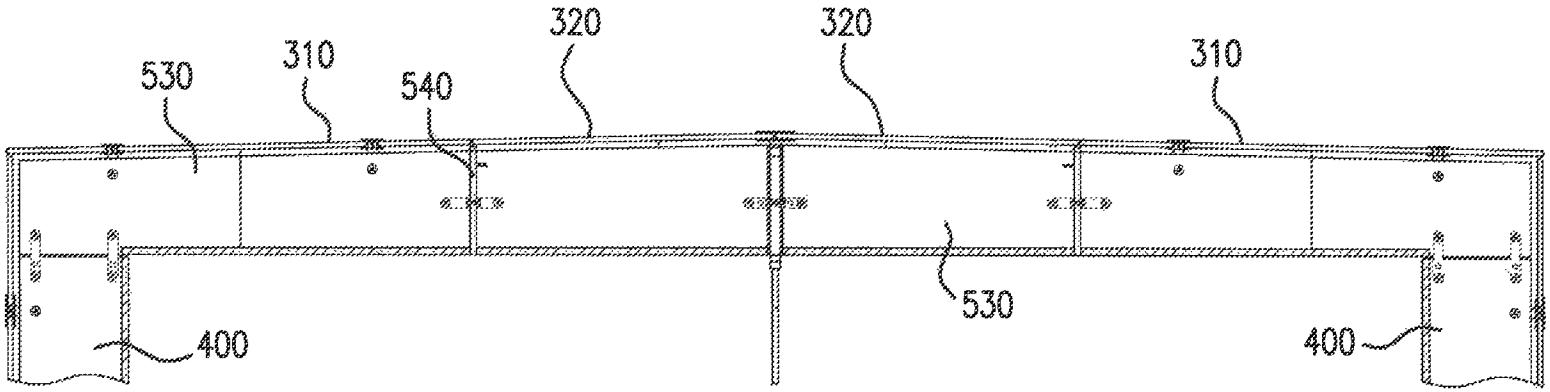
FIG. 11 is a cross-sectional view of the building of FIG. 9, taken along line 11-11.

Referring to FIG. 5, FIG. 6, and FIG. 8, building 200 includes a plurality of rectangular fins 400 internal to building 200, which act as supports for building 200. Each fin 400 is aligned with a region where long sides 120 of adjacent panels 100 meet. Fins 400 may each be formed of a single, or monolithic, piece of glass, similar to panels 100, or may be formed in segments by multiple pieces of glass. Each fin 400 may be mounted to its corresponding panels 100, by, for example, fittings 210 positioned intermittently joining fin 400 with adjacent panels 100. As would be appreciated by one of skill in the art, various other suitable mounting techniques or hardware may be used.

Fins 400 may have a length L2, which may be, for example, 33'. Fins 400 may have a width W2, which may be, for example, 2'3 9/16". Fins 400 may have a thickness of, for example, 2 13/16".

Referring to FIG. 5, FIG. 7, FIG. 8, FIG. 9, FIG. 10, and FIG. 11, building 200 also includes a plurality of first beams 510, a plurality of second beams 520, third beam 530, and cylindrical support 540. Cylindrical support 540 may include a plurality of curved beams 550.

Third beam 530 may be positioned so as to align with regions where long sides 120 of adjacent panels 100 meet. Third beam 530 may, at one end, connect to a first set of adjacent panels 100, and may extend across the diameter of building 200 to connect to a second set of adjacent panels, opposite to the first. Third beam 530 may be formed of a single, or monolithic, piece of glass, similar to panels 100, or may be formed in segments by multiple pieces of glass.

Third beam 530 may have a length L3, which may be, for example, 32'⅛". Third beam 530 may have a width that may be, for example, 1'11⅝" at at least one end. Third beam 530 may have a thickness of, for example, 2 13/16". Third beam 530 may be shaped so that its width increases gradually from its ends to its midpoint.

Second beams 520 may be positioned to as to align with regions where long sides 120 of adjacent panels 100 meet. Second beams 520 may, at one end, connect, to corresponding adjacent panels 100, and may, at the other end, connect to third beam 530 at its midpoint. Building 200 may include two second beams 520, positioned on opposite sides of third beam 530 and oriented so as to form 90° angles with third beam 530 when viewed from above. Second beams 520 may each be formed of a single, or monolithic, piece of glass, similar to panels 100, or may be formed in segments by multiple pieces of glass.

Second beams 520 may have a length L4, which may be, for example, 15'9 11/16". Second beams 520 may have a width that may be, for example, 1'11⅝" at at least one end. Second beams 510 may have a thickness of, for example, 2 13/16". Second beams 510 may be shaped so that their width increases gradually from the end connected to panels 100 to the end connected to third beam 530.

Cylindrical support 540 is a cylinder-shaped support that has its center point at the center point of building 200, such that the circles formed by building 200 and cylindrical support 540 when viewed from above are concentric. Cylindrical support 540 may be attached to panels 100 through first beams 510, second beams 520, and third beam 530. Cylindrical support 540 may be made up of a plurality of curved beams 550. Cylindrical support 540 may include four curved beams 550. Each curved beam 550 may be connected at one end to third beam 530, and at the other end to a second beam 520, so as to form a cylindrical shape bisected in a first direction by third beam 530 and in a second direction perpendicular to the first by second beams 520. Curved beams 550 may each be formed of a single, or monolithic, piece of glass, similar to panels 100, or may be formed in segments by multiple pieces of glass.

Figure 7:
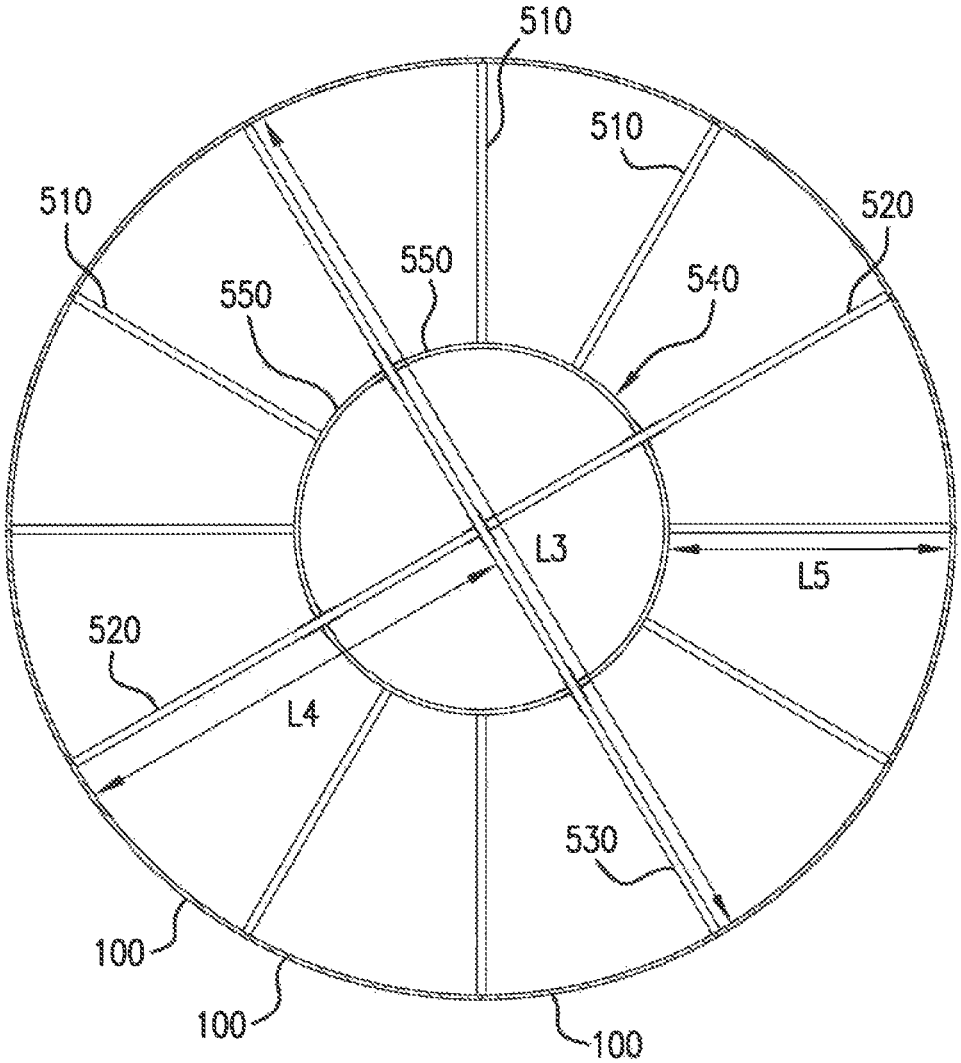
FIG. 7 is a cross-sectional view of the building of FIG. 5, taken along line 7-7.

Curved beams 550 may each form a cylindrical arc when viewed from above (as in, for example, FIG. 7). The cylindrical arc may subtend an angle of, for example, 90°, and may have a radius of, for example, 6'6". Curved beams 550 may have a width of 2'3 1/16". Curved beams 550 may have a thickness of 1'4/16".

First beams 510 may be rectangular, and may be positioned so as to align with regions where long sides 120 of adjacent panels 100 meet. First beams 510 may, at one end, connect to corresponding adjacent panels 100, and may, at the other end, connect to cylindrical support 540. Building 200 may include eight first beams 510. First beams 510 may each be formed of a single, or monolithic, piece of glass, similar to panels 100, or may be formed in segments by multiple pieces of glass.

First beams 510 may have a length L5, which may be, for example, 9'5 1/16".

First beams 510 may have a width W3, which may be, for example, 1'11⅝". First beams 510 may have a thickness of, for example, 2 13/16". First beams 510 may be shaped so that their width increases gradually from the end connected to panels 100 to the end connected to cylindrical support 540.

Figure 12:
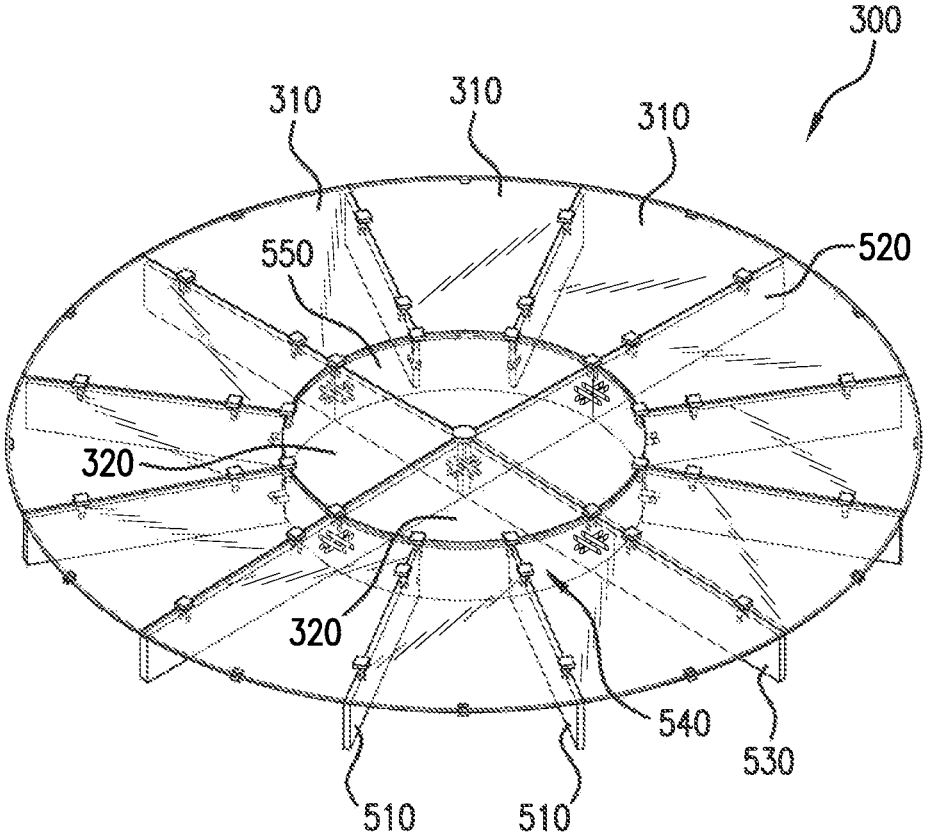
FIG. 12 is a perspective view of the roof of the building of FIG. 5.
Figure 13:
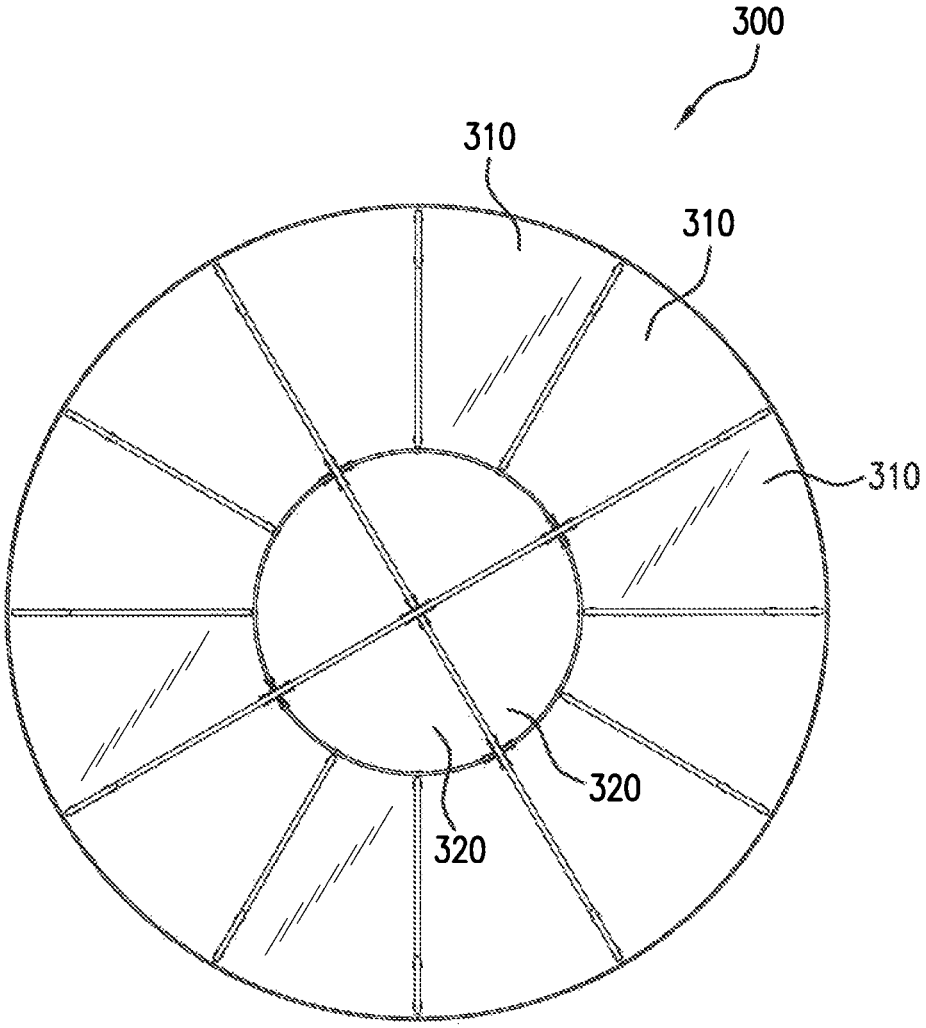
FIG. 13 is a schematic top view of the roof of the building of FIG. 5.

FIG. 12 is a perspective view of roof 300 of building 200. FIG. 13 is a schematic top view of roof 300. Roof 300 includes a plurality of first roof panels 310 and a plurality of second roof panels 320. Roof 300 may be peaked at its center.

Figure 14:
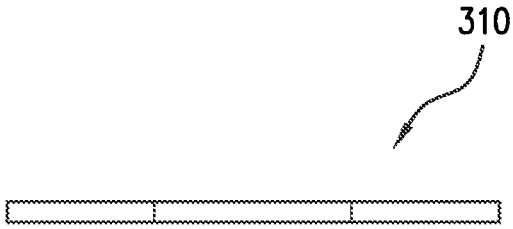
FIG. 14 is a side view of a first roof panel of the roof of the building of FIG. 5.
Figure 15:
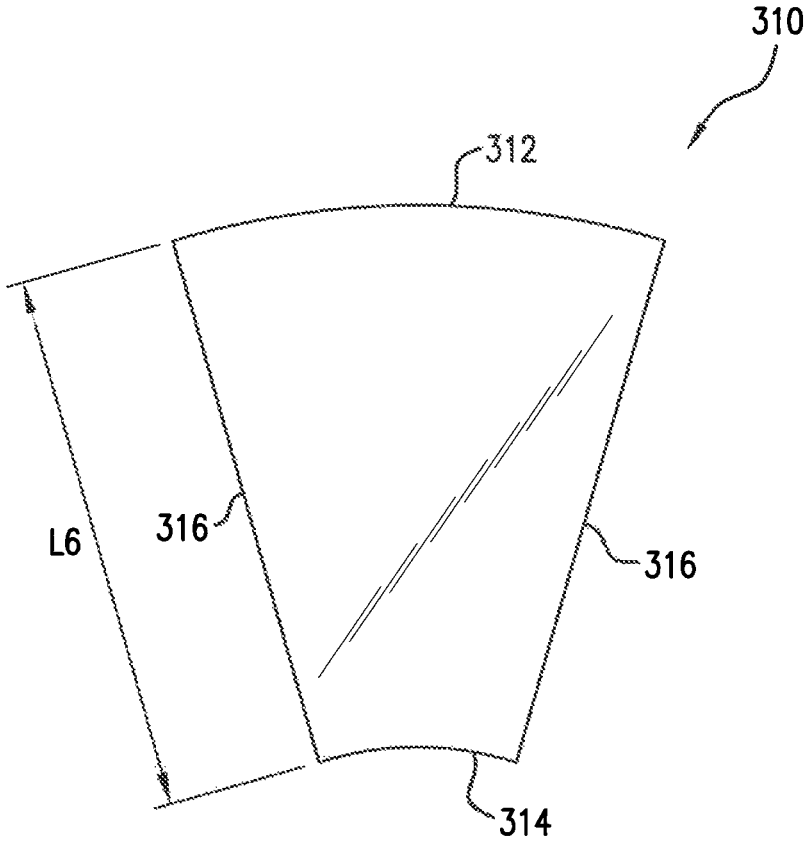
FIG. 15 is a top view thereof.

FIG. 14 is a side view of a first roof panel 310 of roof 300. FIG. 15 is a top view thereof Each first roof panel 310 has a planar shape defined by an outer first circular arc 312, an inner first circular arc 314, and two straight first sides 316 connecting the ends of outer first circular arc 312 to the ends of inner first circular arc 314. First sides 316 define lines that, if extended beyond the limits of first roof panel 310, would cross at a point that corresponds to the center point of both outer first circular arc 312 and inner first circular arc 314. First roof panels 310 may be each formed of a single, or monolithic, piece of glass, similar to panels 100, or may be formed in segments by multiple pieces of glass.

First roof panels 310 are positioned as a part of roof 300 such that outer first circular arc 312 of a first roof panel 310 aligns with a short side 110 of a corresponding panel 100, and such that each first side 316 of a first roof panel 310 meets a first side 316 of an adjacent first roof panel 310. An arc length of first outer circular arc 312 may correspond to the arc length of panel 100. Roof 300 may include twelve first roof panels 310.

Outer first circular arc 312 may have a radius with respect to the center point of, for example, 16'3". Inner first circular arc 314 may have a radius with respect to the center point of, for example, 6'6". First sides 316 may have a length L6 of, for example, 9'5 1/16". First roof panel 310 may have a thickness of 1 4/16". Outer first circular arc 312 and inner first circular arc 314 may subtend an angle with respect to the center point of 30°.

Figure 16:
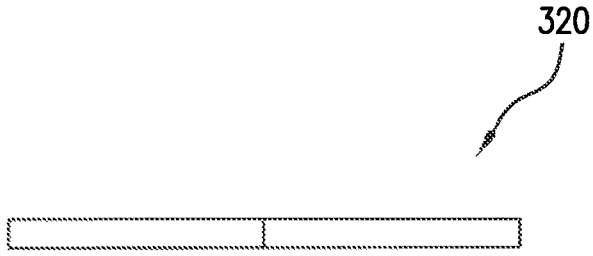
FIG. 16 is a side view of a second roof panel of the roof of the building of FIG. 5.
Figure 17:
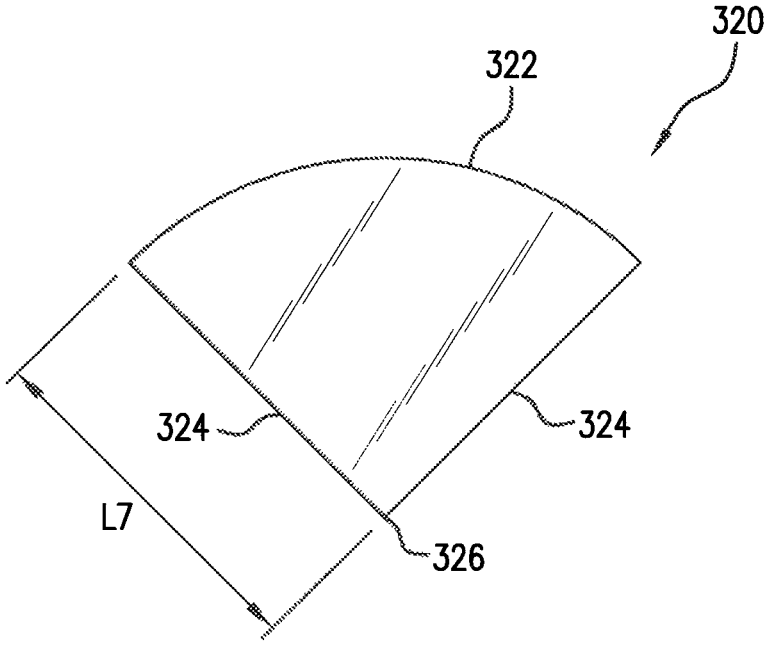
FIG. 17 is a top view thereof.

FIG. 16 is a side view of a second roof panel 320 of roof 300. FIG. 17 is a top view thereof. Each second roof panel 320 has a planar shape defined by a second circular arc 322 and two straight second sides 324, where each of the two second sides 324 connects to one end of second circular arc 322 and to the other second side. Second sides 324 meet at a corner 326, corresponding to the center point of second circular arc 322. Second roof panels 320 may each be formed of a single, or monolithic, piece of glass, similar to panels 100, or may be formed in segments by multiple pieces of glass.

Second roof panels 320 are positioned as a part of roof 300 such that second circular arc 322 aligns with adjacent inner first circular arcs 314, and such that each second side 324 of a second roof panel 320 meets a second side 324 of an adjacent second roof panel 320. In such a configuration, the corners 326 of second roof panels 320 may meet. An arc length of second circular arc 322 may correspond to the arc length of the inner first circular arcs 314 of three adjacent first roof panels 310. Roof 300 may include four second roof panels.

Second circular arc 322 may have a radius with respect to the center point of, for example, 6'6", Second sides 324 may have a length L7 of, for example, 6'4 10/16", Second roof panel 320 may have a thickness of 1 4/16". Second circular arc 322 may subtend an angle with respect to the center point of 90°.

The panels 100, fins 400, first beams 510, second beams 520, third beams 530, curved beams 550, first roof panels 310, and second roof panels 320 may each be made of layered glass. The layered glass may include two opposing exterior glass layers connected by an adhesive layer (such as is depicted in, for example, FIG. 4). Alternatively, the layered glass may include at least one interior glass layer, connected to other interior glass layers or exterior glass layers by adhesive layers, as would be appreciated by one of skill in the art. The number of glass layers used may be from two to five. As an example, panels 100 may include two glass layers, fins 400 may include five glass layers, first beams 510 may include five glass layers, second beams 520 may include five glass layers, third beams 530 may include five glass layers, curved beams 550 may include three glass layers, first roof panels 310 may include three glass layers, and second roof panels 320 may include three glass layers.

The glass layers described above may have various thicknesses, as would be appreciated by one of skill in the art. For example, the glass layers may range from ⅜" to 9/16" in thickness. Additionally, the glass layers may have been subject to various treatments as would be appreciated by one of skill in the art. For example, the glass layers may be fully tempered, heat strengthened, or annealed. As described above with reference to FIG. 4, the adhesive used between adjacent glass layers may be polyvinyl butyral (PVB) or SGP interlayer. An adhesive layer may have a thickness of 1/16".

In some exemplary embodiments, building 200 including panels 100 may optionally incorporate at least one panel 100 that is shorter (has a smaller L1 measurement, for example 28'8⅝") than the other panels 100 and that is positioned with its top short side 110 aligned with the top short sides 110 of the other panels 100 so as to create an opening 220 in the exterior of building 200 at a lower end thereof (see, for example, FIG. 5). A corresponding fin 400 may also be included that is shorter than the other fins 400, and is positioned with its top end aligned with the top ends of the other fins 400. Such a corresponding fin may be mounted to its corresponding panels 100 by fittings that are different from fittings 210 used to mount the other fins 400.

Opening 220 can be used as an entrance to building 200. Opening 220 may be fitted with doors 230, which may be glass, and which may be curved so as to match the profile of panels 100. Building 200 may further optionally include an awning 240 extending from the exterior of building 200 over an area corresponding to the opening. Awning 240 may also extend within building 200 and be attached to at least one fin 400. Building 200 may also include various fittings 250 in addition to the fittings already described.

The positions of panels 100, fins 400, first beams 510, second beams 520, third beams 530, curved beams 550, first roof panels 310, and second roof panels 320 are described above to some extent based on their orientation with respect to other elements of building 200. In many cases, edges or sides of panels 100, fins 400, first beams 510, second beams 520, third beams 530, curved beams 550, first roof panels 310, and second roof panels 320 are described as proximate to other edges or sides of panels 100, fins 400, first beams 510, second beams 520, third beams 530, curved beams 550, first roof panels 310, and second roof panels 320. As would be appreciated by one of skill in the art, building 200 may include fittings to connect these elements to one another. These fittings may include, for example, clamps, threaded elements, adhesive elements, anchors, holes, or any combination thereof. These fittings may be separable from the other elements of building 200, or may be integrally formed therewith. For example, portions of the fittings may, in the case of glass building elements, be laminated with the glass to as to be integrally formed therewith.

The numbers, values, amounts, ranges, and the like that have been described above with reference to exemplary embodiments of the present invention are presented as examples, and are not limiting. As one of skill in the art would appreciate, the numbers, values, amounts, ranges, and the like presented above may be varied within appropriate ranges without departing from the spirit and scope of the present invention.

The various elements of building 200, including panels 100, fins 400, first beams 510, second beams 520, third beams 530, curved beams 550, first roof panels 310, and second roof panels 320 have been described above in exemplary positions relative to each other, and in exemplary shapes, numbers, sizes, dimensions, and other qualities. It will be appreciated by one of skill in the art that the elements of building 200 may be configured in a wide variety of positions, shapes, numbers, sizes, dimensions, and other qualities and that the configuration used may depend on many factors, including, for example, the overall size and dimensions of the building and available area for the building, the aesthetic appearance desired, or the structural specifications desired.

While various exemplary embodiments of the present invention have been described above, they have been presented by way of example only, and not limitation. The elements of the exemplary embodiments presented above are not necessarily mutually exclusive, but may be interchanged to meet various needs as would be appreciated by one of skill in the art.

It therefore will be apparent to one skilled in the art that various changes in form and detail can be made to the exemplary embodiments disclosed herein without departing from the spirit and scope of the present invention. The phraseology or terminology herein is used for description and not for limitation. Thus, it is intended that the present invention cover modifications and variations of this invention provided they come within the scope of the appended claims and their equivalents.

What is claimed is:

1. A glass building, comprising:

a plurality of curved glass panels disposed adjacent to each other to form a cylinder, a cylindrical support disposed about a central longitudinal axis of the building;

a plurality of first glass beams, each extending from the panels to the cylindrical support; and a plurality of second glass beams, each extending from the panels to the central longitudinal axis of the building, wherein each panel comprises a monolithic glass piece, wherein each glass piece is substantially rectangular and comprises two opposing long sides extending in a height direction and two opposing short sides extending substantially in a width direction, wherein each glass piece forms an identical circular arc when viewed from either of the two opposing short sides, and wherein at least one glass piece extends from a base of the building exterior to above at least a portion of a roof beam supporting a roof of the building.

2. The building of claim 1, further comprising a plurality of glass fins supporting the panels, the fins being disposed where adjacent panels meet.

3. The building of claim 2, wherein the fins have the same length as the panels and are each formed of a monolithic glass piece.

4. The building of claim 1, further comprising:

a third beam formed of glass, extending across the building through the central longitudinal axis of the building.

5. The building of claim 1, further comprising a roof, wherein the roof comprises:

a plurality of first glass roof panels; and a plurality of second glass roof panels, wherein each of the first glass roof panels has a planar shape defined by an outer first circular arc, an inner first circular arc, and two straight first sides connecting the ends of the outer first circular arc to the ends of the inner first circular arc, wherein each of the second glass roof panels has a planar shape defined by a second circular arc and two straight second sides, each of the two second sides connecting to one end of the second circular arc and to the other second side, and wherein each outer first circular arc, each inner first circular arc, and each second circular arc share a center point.

6. The building of claim 5, wherein the plurality of first glass roof panels comprises twelve and the plurality of second glass roof panels comprises four.

7. The building of claim 5, wherein each outer first circular arc has a radius of 16'3" and subtends an angle of 30°, wherein each inner first circular arc has a radius of 6'6" and subtends an angle of 30°, and wherein each second circular arc has a radius of 6'6" and subtends an angle of 30°.

8. The building of claim 5, wherein the plurality of first glass roof panels and the plurality of second glass roof panels are aligned with the cylindrical support, the first beams, the second beams, and the third beam.

9. The building of claim 1, further comprising one or more glass roof panels forming a glass circle, wherein the glass circle is disposed on a top end of the cylinder to form a roof.

10. The building of claim 1, wherein the panels are longer in the height direction than in the width direction.

11. A glass building, comprising:

a plurality of curved glass panels disposed adjacent to each other to form a cylinder;

a cylindrical support disposed about a central longitudinal axis of the building;

a plurality of first glass beams, each extending from the panels to the cylindrical support; and a plurality of second glass beams, each extending from the panels to the central longitudinal axis of the building.

12. The building of claim 11, wherein each glass panel is substantially rectangular and comprises two opposing long sides extending in a height direction and two opposing short sides extending substantially in a width direction.

13. The building of claim 11, wherein each of the curved glass panels is formed as a monolithic glass piece.

14. The building of claim 11, wherein each glass panel is substantially rectangular and comprises two opposing sides extending in a height direction and two opposing sides extending in a width direction, wherein the two opposing sides extending in the height direction are longer than the two opposing sides extending in the width direction.

15. The building of claim 11, wherein at least one glass panel has a height greater than approximately 26'.

16. The building of claim 11, wherein the cylinder has a radius of between approximately 15' and 17'.

17. The building of claim 11, wherein at least one glass panel has an arc length of between approximately 8' and 9'.

18. The building of claim 11, wherein at least one glass panel comprises a plurality of laminated glass layers.

19. The building of claim 11, further comprising:

at least one fitting laminated integrally with layers of at least one glass panel.

20. The building of claim 11, further comprising:

at least one fitting laminated integrally with layers of at least one glass panel, wherein the at least one fitting couples the at least one glass panel to an adjacent glass panel.

21. The building of claim 11, further comprising a plurality of glass fins supporting the glass panels, wherein the fins are disposed where adjacent panels meet.

22. The building of claim 11, further comprising one or more glass roof panels forming a glass circle, wherein the glass circle is disposed on a top end of the cylinder to form a roof.

23. A glass structure, comprising:

a plurality of curved glass panels disposed adjacent to each other to form a cylinder;

a support disposed about a central longitudinal axis of the structure;

a first support beam extending from a cured glass panel to the support; and a second support beam extending from a curved glass panel to the central longitudinal axis of the building.

24. The structure of claim 23, wherein the second support beam is at least partially disposed within the support.

25. The structure of claim 23, wherein the first support beam is coupled to an outer face of the support, and wherein the support is supported by the first support beam.

* * * * *

UNITED STATES PATENT AND TRADEMARK OFFICE

CERTIFICATE OF CORRECTION

PATENT NO. : 8,544,217 B2
APPLICATION NO. : 13/107116
DATED : October 1, 2013
INVENTOR(S) : Andreini et al.

It is certified that error appears in the above-identified patent and that said Letters Patent is hereby corrected as shown below:

In the Claims:

In column 10, line 36 (claim 23): "a cured glass panel" should be --a curved glass panel--.

Signed and Sealed this
Third Day of December, 2013

Margaret A. Focarino

Margaret A. Focarino
*Commissioner for Patents of the United States Patent and Trademark Office*